United States Patent [19]

Buck, Jr. et al.

[11] 4,047,991

[45] Sept. 13, 1977

[54] POLYESTER BATT AND METHOD FOR PRODUCING SUCH

[75] Inventors: George Sumner Buck, Jr.; Robert George Weyker, both of Memphis; Arthur Gerard Ward, Arlington, all of Tenn.

[73] Assignee: Fiberlok, Inc., Memphis, Tenn.

[21] Appl. No.: 612,786

[22] Filed: Sept. 12, 1975

[51] Int. Cl.[2] ..... B32B 31/00

[52] U.S. Cl. ..... 156/62.6; 156/62.2; 156/204; 156/283; 156/320; 264/122; 428/283; 428/288

[58] Field of Search ..... 156/62.2, 62.6, 283, 156/320, 204; 428/206, 296, 283, 288, 289, 290, 302, 327, 360, 372, 381; 264/122

[56] References Cited

U.S. PATENT DOCUMENTS

| | | | |
|---|---|---|---|
| 2,568,144 | 9/1951 | Cremer et al. | 428/360 |
| 2,808,098 | 10/1957 | Chavannes et al. | 156/62.6 |
| 2,972,554 | 2/1961 | Muskat et al. | 428/360 |
| 3,033,726 | 5/1962 | Howden | 156/62.6 |
| 3,117,055 | 1/1964 | Guandique et al. | 428/290 |
| 3,369,948 | 2/1968 | Ostmann | 428/296 |
| 3,498,875 | 3/1970 | Lindemann et al. | 428/283 |
| 3,753,826 | 8/1973 | Plummer | 428/206 |

FOREIGN PATENT DOCUMENTS

| | | | |
|---|---|---|---|
| 550,712 | 12/1957 | Canada | 156/62.6 |

*Primary Examiner*—James J. Bell
*Attorney, Agent, or Firm*—Littlepage, Quaintance, Murphy, Richardson & Webner

[57] ABSTRACT

A process for producing a polyester batt by forming a thin web of polyester fibers and then contacting the web with particles of a copolymer of vinyl chloride and vinylidene chloride; subsequently forming the web into a batt and then heating the batt.

8 Claims, 3 Drawing Figures

FIG. 1
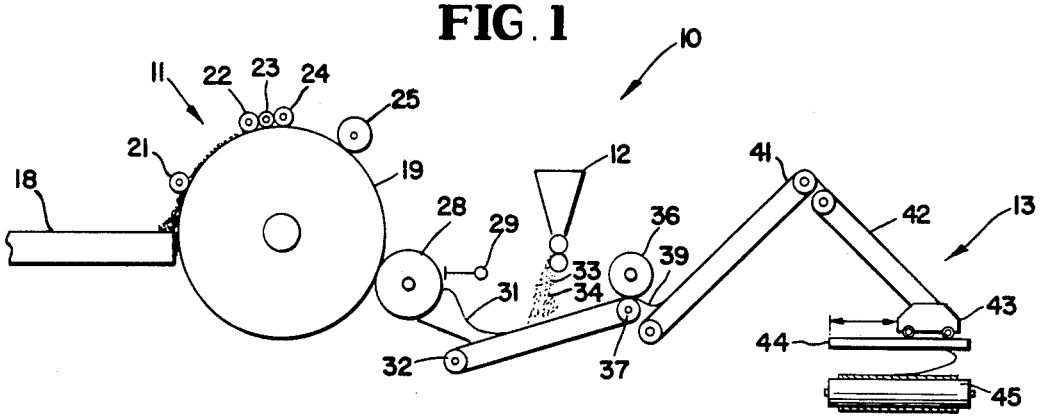
FIG. 2
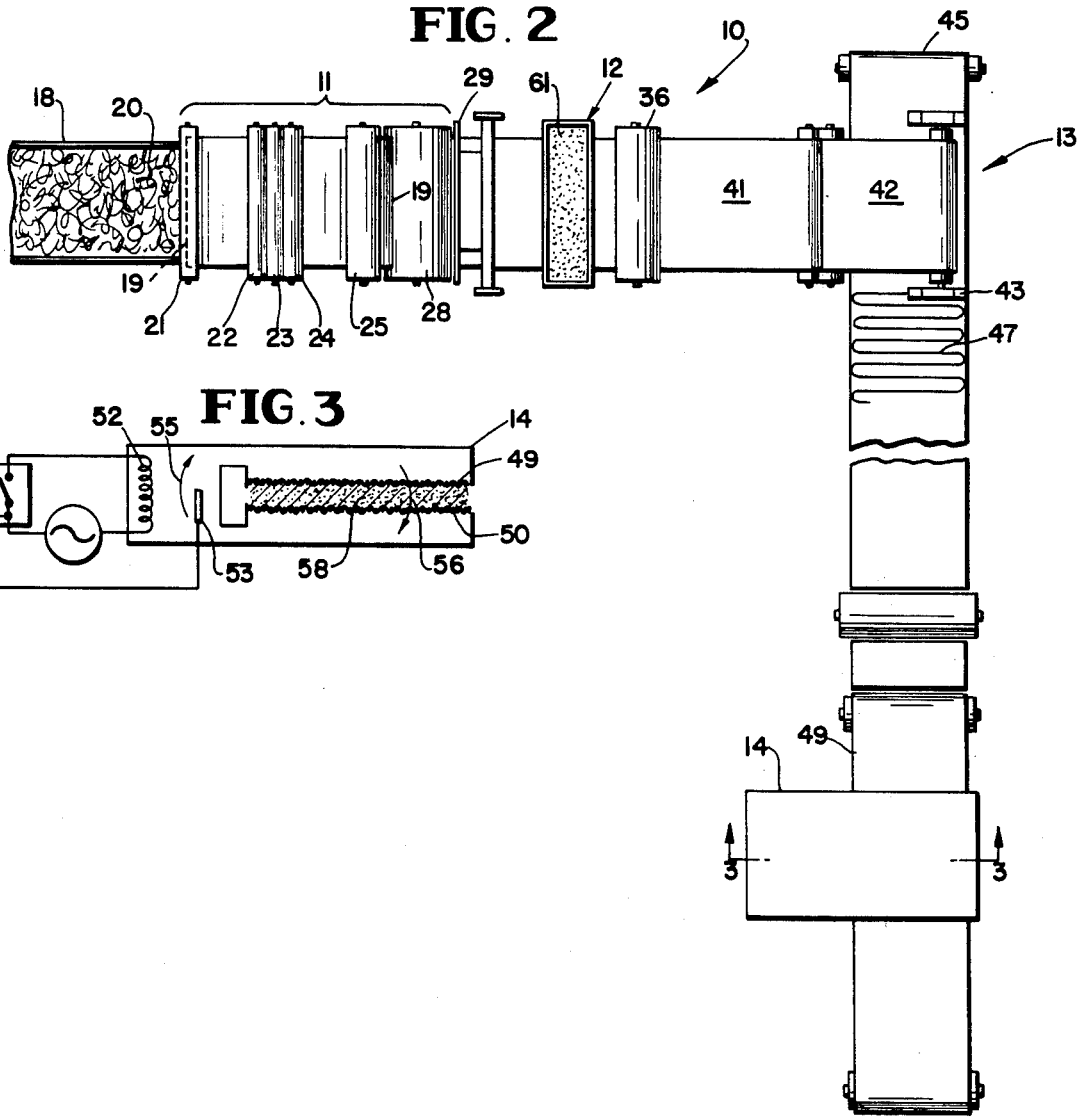
FIG. 3

POLYESTER BATT AND METHOD FOR PRODUCING SUCH

Completely dry processes for forming fibrous batts are known and are described, for example, in Fleissner U.S. Pat. No. 3,765,971. However, prior processes such as those of Fleissner suffer from a number of disadvantages. First, it has been difficult or impossible to uniformly admix the particulate binding agent with the fibers to be bound. This lack of uniform mixing causes a resultant batt of non-uniform strength. Second, prior efforts to indentify a practical, dry adhesive have been unsuccessful.

It is therefore an object of the present invention to provide an improved method for producing a polyester batt which is substantially free of the disadvantages of the prior art.

Another object is to provide an improved method which produces a batt of uniform strength.

A further object is to provide an improved method that employs an especially advantageous binding material.

A still further object is to provide an improved polyester batt.

Additional objects and advantages of the present invention will be apparent to those skilled in the art by reference to the following detailed description and drawings wherein:

FIG. 1 is an elevation view of an apparatus suitable for practicing the process of the present invention.

FIG. 2 is a plan view of the apparatus of FIG. 1.

FIG. 3 is a sectional view taken along line 3–3 of FIG. 2.

The above and other objects are accomplished according to the present invention by providing a process comprising the steps of:

forming a thin web of polyester fibers;

contacting the web with an adhesive amount of particles of a copolymer of vinyl chloride and vinylidene chloride;

forming the web into a batt; and, heating the web to a temperature above the sticking point of the copolymer but below the melting point of the polyester.

The polyester fibers useful to produce the thin web can be from any source. For reasons explained more completely below, the thin web is generally only from 1 to 200 and preferably from 1 to 100 fibers thick.

The copolymer generally has a weight ratio of vinyl chloride to vinylidene chloride of 1:99 to 40:60 and preferably 5:95 to 25:75. At higher ratios, the copolymer exhibits no properties not separately obtained by the use of a homopolymer of vinyl chloride. Likewise, at lower ratios, the use of the copolymer gives no advantages not achieved by the use of pure vinylidene chloride. The copolymer is applied to the web in an amount sufficient to function as an adhesive and generally in a weight ratio of the copolymer to the polyester of 1:99 to 30:70 and preferably 10:90 to 20:80. The copolymer particles generally have a size range of from 1 to 200 and preferably from 5 to 50 microns. Smaller sizes are useful technologically but are expensive to produce. Larger sizes not only unnecessarily increase the weight of the resultant batt but also reduce the number of cross-links possible with a given weight of copolymer which reduces bonding efficiency and strength. Copolymers useful in the present invention have a sticking point of from 300° to 370° F. All copolymers of vinyl chloride and vinylidene chloride useful in the present invention either have this property or can be modified to produce this property according to techniques well known in the art which form no part of the present invention. Copolymers useful in the present invention are available from the Dow Chemical Company, Midland, Michigan, under the following tradenames: Saran Resin XP-5230.04, Saran Resin XP-2384.49, Saran Resin XP-4174.19, Saran Resin XP-5230.05, Saran Resin XP-5230.06, and Saran Resin XP-5230.08.

As used herein the term "polyester" refers to high molecular weight fiber-forming polymers with recurring ester linkages in the backbone. The preferred polyester is polyethylene terephthalate, the preparation of which is described in Whinfield et al U.S. Pat. No. 2,465,319.

After the copolymer is contacted with the web, the web is formed into a batt. It is impractical to contact the copolymer with the preformed batt since it is difficult or impossible to insure penetration of the particles into the batt. As used herein, a batt is meant to refer to a plurality of webs.

The batt, formed as described above, is then heated to a temperature above the sticking point of the copolymer but below the melting point of the polyester and generally at a temperature of 300° to 400° F and preferably at 325° to 375° F. At much lower temperatures, the copolymer does not melt whereas at higher temperatures, the polyester is adversely effected. The heating is conducted for a time sufficient to effect the desired melting of the copolymer which generally occurs within a period of from 1 to 20 minutes and preferably 2 to 10.

Referring now to the drawings and in particular to FIG. 1, there is shown an apparatus 10 useful for practicing the process of the present invention. The apparatus 10 comprises an opener or a garnett 11, a particle dispenser 12, a cross-laying mechanism 13 and, as shown in FIG. 2, an oven 14. The garnett 11 comprises an inlet chute 18 adapted to feed bulk polyester to the rotating drum 19 of the garnett 11. The garnett 11 is also provided with a plurality of tooth rolls 21, 22, 23, 24, 25 which together with the teeth not shown on the drum 19 take bulk polyester 20 and convert it to a web which adheres to the drum 19. The web adhering to the drum 19 is transferred to the drum 28 where it is removed by a comb 29. The web 31 that is now only between 1 and 100 fibers thick and is barely self-supporting drops to conveyor 32 where it passes under the particle dispenser 12. While on the conveyor 32 and supported thereby, the web 31 is contacted with particles 33, 34 which fall from the particle dispenser 12 under the influence of gravity. By virtue of the fact that the web 31 is supported on the conveyor 32, the particles 33, 34 do not pass through the web 31 but rather are retained by it. To further insure retention by the web 31 of the particles 33, 34, the web 31 is passed between the nip of two rotating rolls 36, 37; the lower roll 37 performing the dual function of providing a support for the conveyor 32. The web 39 then goes to the conveyor 41 and thence to the conveyor 42. In a manner well known in the art, the lower end of the conveyor 42 is attached to a traveller 43 which moves back and forth on the track 44. The conveyor 42 is positioned above and at right angles to the conveyor 45. The apparatus is adjusted such that the speed of the conveyor 42 is several times faster than the speed of the conveyor 45. By virtue of this arrangement, the web 39 is cross-layed back and forth on the conveyor 45 thus forming an unheat-treated batt 47. The unheat-treated batt 47 passes between an upper foraminous belt 49 and a lower foraminous belt 50 (see FIG. 3). While held between the belts 49, 50, the unheat-treated batt 47 passes into the oven 14. As shown in FIG. 3, the oven 14 is provided with heating means 52 which can be thermostatically controlled by a thermostat 53. The oven 14 is also provided with air circulating means not shown that causes the air to circulate in the direction shown by the arrows 55 and 56. The batt then cools to room temperature whereupon the copolymer resolidifies. The resultant product is the final heat-treated batt 58.

The invention may be understood by reference to the following non-limiting examples. These examples are designed to teach those skilled in the art how to practice the invention and represent the best mode contemplated for practicing the invention. Unless otherwise specified, all parts and percentages are by weight.

EXAMPLE 1

A copolymer of vinyl chloride and vinylidene chloride available from the Dow Chemical Company, Midland, Michigan under the designation XP-5230.04 is added to a polyester web in the manner described above with respect to the drawings. This copolymer has a weight ratio of vinyl chloride to vinylidene chloride of 10:90, a chlorine content of 71%; a plasticizer content of 1%, a minimum particle size of 40 microns and a maximum particle size of 100 microns.

EXAMPLES 2-6

The procedure of Example 1 is repeated except that the copolymer employed in Example 1 is replaced by that copolymer shown in column 2 of the attached table.

II. contacting the web with an adhesive amount of particles of a copolymer of vinyl chloride and vinylidene chloride;

III. forming the web into a batt by laying the web transversely back and forth on a moving belt such that the batt comprises a plurality of webs; and then IV. heating the batt to a temperature above the sticking point of the copolymer but below the melting point of the polyester wherein the copolymer particles have a size range of from 1 to 200 microns, wherein the weight ratio of vinyl chloride to vinylidene chloride is 1:99 to 40:60 and wherein the weight ratio of the copolymer to the polyester is 1:99 to 30:70.

2. The process of claim 1 wherein the thin web is horizontally disposed.

3. The process of claim 1 wherein the copolymer has a sticking point of 300° to 370° F.

4. The process of claim 1 wherein the contacting of the web with the particles is effected by dropping the particles on the web under the influence of gravity.

5. The process of claim 1 wherein the temperature in step IV is between 300° and 400° F.

6. The process of claim 1 wherein the heating is conducted for a period of from 1 to 20 minutes.

7. A completely dry process for producing a polyester batt of uniform strength comprising in sequence the steps of:

I. forming a horizontally disposed, thin, planar web of polyester fibers, said web being from 1 to 100 fibers thick;

II. contacting the web with particles of a copolymer of vinyl chloride and vinylidene chloride while the web is in contact with and supported by a moving belt thereby inhibiting the passage of particles through the web;

TABLE

| (Designation) | Weight Ratio of Vinyl Chloride to Vinylidene Chloride | Chlorine Content (Wt. %) | Plasticizer Content (Wt. %) | Plasticizer Type (Designation) | Stabilizer Content (Wt. %) | Stabilizer Type (Designation) | Minimum Particle Size (μ) | Maximum Particle Size (μ) |
|---|---|---|---|---|---|---|---|---|
| XP-5230.04 | 10/90 | 71 | ≦1% | Citrate | None | — | 40[1] | 100[1] |
| XP-2384.49 | 10/90 | 71 | 6 | Citrate | 2 | Benzophenone | Standard Granulation (Not Micronized) | |
| XP-4174.19 | 15/85 | 70 | ≦1% | Citrate | None | — | Standard Granulation (Not Micronized) | |
| XP-5230.05 | 21/79 | 67 | ≦1% | Citrate | None | — | * | * |
| XP-5230.06 | 15/85 | 69 | ≦1% | Citrate | None | — | ** | ** |
| XP-5230.08 | 7/93 | 72 | 6.0 | Citrate | 1.0 | Epox. Sobyean Oil | *** | *** |

Notes

[1]Actual particle size is as follows:

| | |
|---|---|
| through 60 on 200 mesh (75μ–250μ) | 2% |
| through 200 on 325 mesh (45μ – 75μ) | 77.8% |
| through 325 mesh (less than 45 μ) | 20% |
| *on 100 mesh (greater than 150μ) | 14% |
| thru 100, on 200 mesh (75μ to 150μ) | 17% |
| thru 200, on 325 mesh (45μ to 75μ) | 30% |
| thru 325 mesh (less than 45μ) | 39% |

** through 200 on 325 mesh (45μ – 75μ) 4%
through 325 mesh (less than 45μ) 96%

*** typical customer audit
over 40 microns - 10% maximum
1–40 microns - 90% minimum
under 1 micron - 10% maximum Although the invention has been described in considerable detail with reference to certain preferred embodiments thereof, it will be understood that variations and modifications can be effected within the spirit and scope of the invention as described above and as defined in the appended claims.

What is claimed is:

1. A process for producing a polyester batt comprising the steps of:

I. forming a thin web of polyester fibers;

A. wherein the weight ratio of vinyl chloride to vinylidene chloride is 5:95 to 25:75, B. wherein the weight ratio of the copolymer to the polyester is 10:90 to 20:80, C. wherein the copolymer particles have a size range of 5 microns to 50 microns, D. wherein the copolymer has a sticking point of 300° to 370° F, E. wherein the particles fall on the web under the influence of gravity, III. passing the web and adhering particles through the nip of two rotating rolls to impress the particles into the web;

IV. forming the web into a batt by laying the web transversely back and forth on a moving belt such that the batt comprises a plurality of webs;

V. heating the batt to a temperature of 325° to 375° F for a period of 2 to 10 minutes while the batt is being passed through an oven between two parallel foraminous belts while hot air is forced through the belts and through the batt to melt the copolymer;

VI. cooling the batt to room temperature to resolidify the copolymer; thereby producing a polyester batt of uniform strength.

8. A polyester batt, the individual fibers of which are bonded at their intersection by melted resolidified particles of a copolymer of vinyl chloride and vinylidene chloride.

* * * * *